US008189811B1

(12) United States Patent
Tillis

(10) Patent No.: US 8,189,811 B1
(45) Date of Patent: May 29, 2012

(54) SYSTEM AND METHOD FOR PROCESSING AUDIO SIGNALS

(76) Inventor: Roy R. Tillis, Columbus, OH (US)

( * ) Notice: Subject to any disclaimer, the term of this patent is extended or adjusted under 35 U.S.C. 154(b) by 201 days.

(21) Appl. No.: 12/838,391

(22) Filed: Jul. 16, 2010

(51) Int. Cl.
*H04R 3/00* (2006.01)

(52) U.S. Cl. ..... 381/96; 381/332; 381/59

(58) Field of Classification Search ..... 381/59, 381/58, 120, 119, 150, 400, 396, 411, 177, 381/96, 98, 97, 89, 332, 121, 111
See application file for complete search history.

(56) References Cited

U.S. PATENT DOCUMENTS 4,152,553 A * 5/1979 White ..... 379/430
2006/0013406 A1* 1/2006 Risch et al. ..... 381/27
2008/0212806 A1* 9/2008 Xi ..... 381/165

* cited by examiner

*Primary Examiner* — Vivian Chin
*Assistant Examiner* — Con P Tran
(74) *Attorney, Agent, or Firm* — Ronald J. Koch

(57) ABSTRACT

An audio signal is processed by passing it through a speaker, the cone of which is mechanically connected to a moving sleeve. A coil is wrapped around the sleeve. There is a metal shaft displaced inside of the sleeve. The shaft is connected to a magnet. Thus, movement of the speaker cone causes the coil to move through a magnetic field which creates a voltage across the coil which is subtracted from the original audio signal to produce a processed output.

2 Claims, 2 Drawing Sheets

FIG. 1
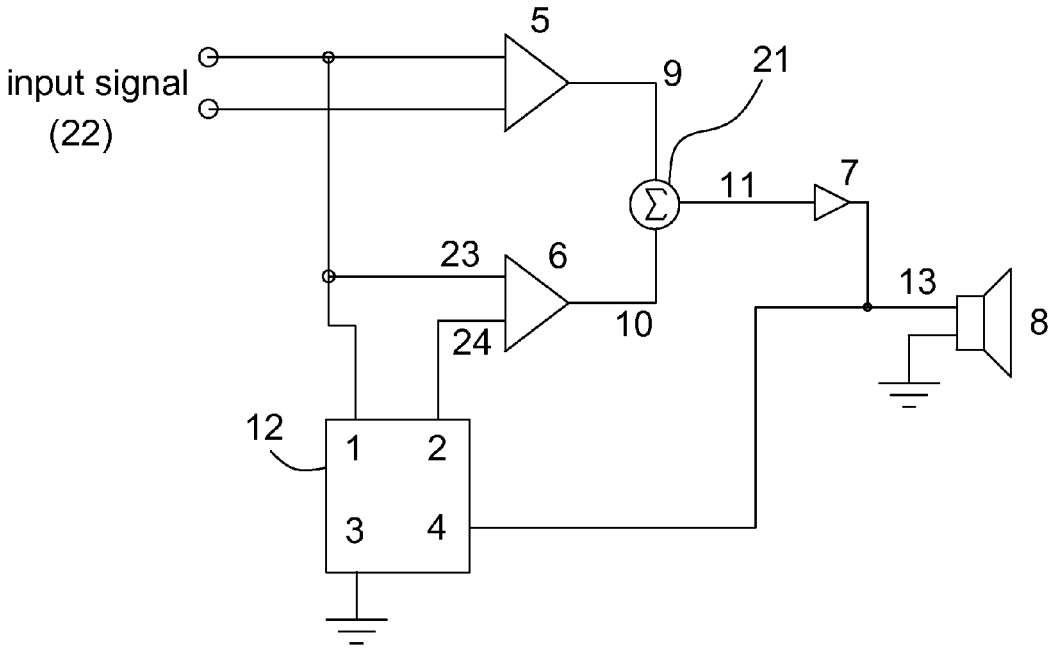
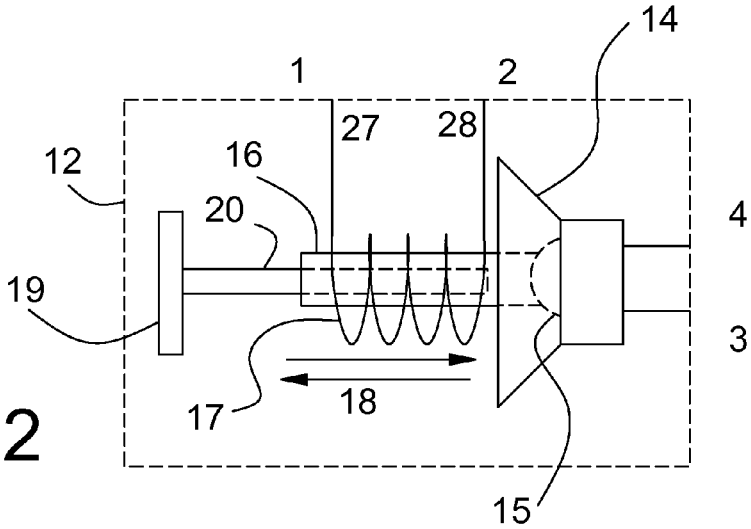
FIG. 2

SYSTEM AND METHOD FOR PROCESSING AUDIO SIGNALS

CROSS REFERENCE TO RELATED APPLICATIONS

Not Applicable

FEDERALLY SPONSORED RESEARCH

Not Applicable

SEQUENCE LISTING, TABLE, OR COMPUTER PROGRAM COMPACT DISK APPENDIX

Not Applicable

CLAIM OF PRIORITY BASED ON COPENDING APPLICATION

N/A

BACKGROUND AND SUMMARY

The present invention relates generally to processing audio signals and more specifically to the reduction or elimination the Doppler effect in loudspeakers.

The Doppler Effect is observed in a passing siren & astronomy (red shift). It is exploited in Doppler radar systems. Indeed, the Doppler Effect is present whenever there is relative movement between an observer and a wave producing source.

It is known that the Doppler effect produces unwanted distortion in audio loudspeakers (aka speakers or loudspeakers). A speaker operates by passing a current through a coil exposed to a magnetic field (usually produced by a fixed magnet). The time varying current in the coil creates a corresponding alternating magnetic field which in turn interacts with the magnet to produce a mechanical force that moves the coil. The coil is mechanically connected to a diaphragm which also moves to produce sound waves through the air.

It is known that the Doppler effect causes distortion in speakers because as the speaker diaphragm moves outwardly (towards the listener) the sound wave is compressed which results in an increase in pitch and conversely a decrease in pitch as the diaphragm moves inwardly (away from the listener). This effect is exacerbated when more than one tone is present. The lower tone modulates the higher tone creating side bands spaced according to the frequency difference. For example, a speaker with tones at 100 & 3 kHz would have side bands at 2900 & 3100 Hz. The side bands are the DD. The degree of Doppler Distortion (DD) is proportional to the difference between the tones. i.e. a greater difference results in more DD. Additionally, the magnitude of the side bands is proportional to the amplitude of the lower frequency signal.

The frequency spectrum of music is diverse. Thus, Doppler distortion is more prevalent and complex in music. Crossover networks can reduce the effect. However, small speakers (e.g. in computer monitors, television sets, and small portable devices) generally do not incorporate crossover circuitry. Thus, there is a need for a system and method of eliminating DD in such systems.

The present invention is useful not only in reducing or eliminating the Doppler effect in loudspeakers, but also in allowing audio signals to be adjusted to create a more pleasing sound to one listening to music. An audio signal is processed by passing it through a speaker, the cone of which is mechanically connected to a moving sleeve. A coil is wrapped around the sleeve. There is a metal shaft displaced inside of the sleeve. The shaft is connected to a magnet. Thus, movement of the speaker cone causes the coil to move through a magnetic field which creates a voltage across the coil. This voltage is proportional to the audio signal with DD. The difference between the original audio signal and the processed signal is DD. This difference is subtracted from the original audio signal to produce an output with minimized or cancelled DD.

BRIEF DESCRIPTION OF THE DRAWINGS

FIG. 1 depicts a schematic of one embodiment of the invention.

FIG. 2 depicts a schematic of the processing component of FIG. 1.

DETAILED DESCRIPTION

Figure 3:
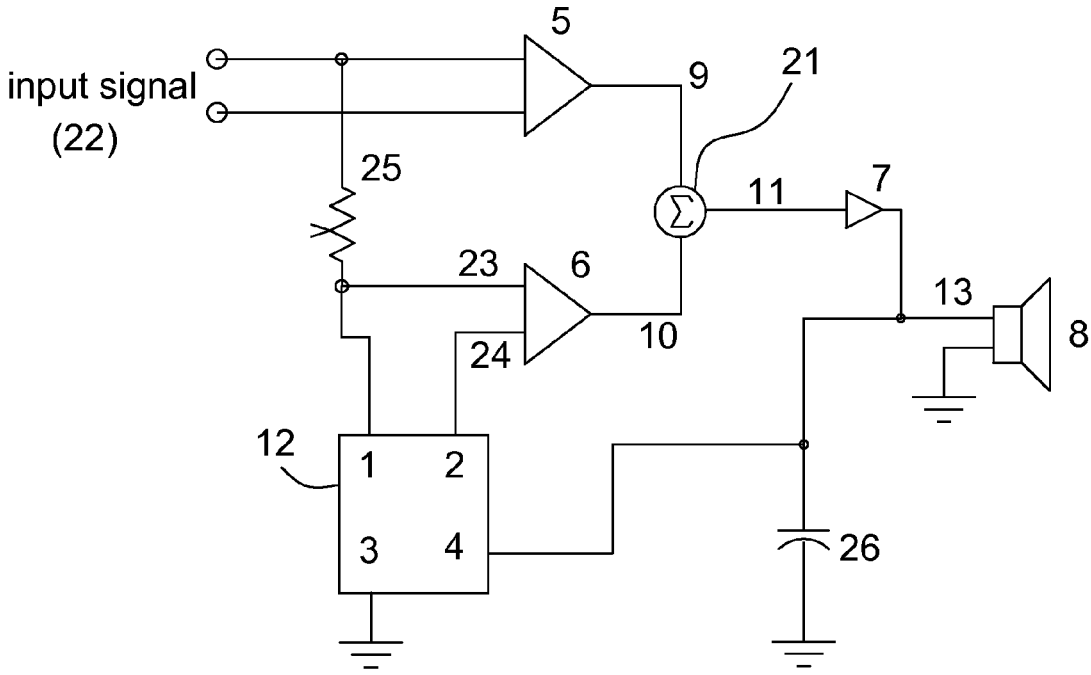
FIG. 3 depicts a schematic of one embodiment of the invention.

One embodiment of a signal processor comprises, first amplifier 5 for amplifying input signal 22 to produce first signal 9; mixer 21 for producing third signal 11 (being the sum of first signal 9 and second signal 10); third amplifier 7 for amplifying third signal 11 to create output signal 13; first loudspeaker 8 operatively connected to output signal 13; first processing component 12 (having, second loudspeaker 14 (which has cone 15), moving sleeve 16, moving coil 17 (having first and second ends 27, 28), stationary magnet 19, and ferromagnetic shaft 20); and second amplifier 6 having first and second inputs 23, 24. It is to be understood that the term "ferromagneteic shaft" includes any material that is attracted to a magnet or conducts magnetic flux.

Second loudspeaker 14 has first grounded input 3 and a second input 4 which is operatively connected to output signal 13. Ferromagnetic shaft 20 is attached to stationary magnet 19. Cone 15 is attached to moving sleeve 16. Moving coil 17 is wrapped around moving sleeve 16. Thus, they are fixed in position relative to each other and move along with cone 15.

A portion of ferromagnetic shaft 20 is displaced within a portion of moving sleeve 16 (FIG. 2). Movement of coil 17 (proportional to cone 15) within the magnetic field created by magnet 19 & shaft 20 causes a voltage to appear across first and second ends 27 & 28.

First end 27 of coil 17 is operatively connected to first output 1, input signal 22 and first input 23 of second amplifier 6. Second end 28 of coil 17 is operatively connected to second output 2, and second input 24 of second amplifier 6. Second amplifier 6 produces second signal 10.

It should be noted that the functionality of mixer 21, and first, second, and third amplifiers 5,6,& 7 can alternatively be achieved using a conventional mixing board. In such an embodiment, other amplification stages, filters, pads, etc. can be employed.

In another embodiment (FIG. 3), variable resistor 25 and first capacitor 26 are incorporated. Variable resistor 25 is operatively connected between the input signal 22 and first output 1 of processing component 12. First capacitor 26 is operatively connected between output signal 13 and ground. It should be noted that first capacitor 26 and variable resistor 25 can be sized to achieve various filter effects and attenuations according to the preference of the listener and the nature of the input signal.

What is claimed is:

1. A signal processor comprising:

a first amplifier for amplifying an input signal to produce a first signal;

a mixer for producing a third signal being the sum of the first signal and a second signal;

a third amplifier for amplifying the third signal to create an output signal;

a first loudspeaker operatively connected to the output signal;

a first processing component having, a second loudspeaker having a cone, a moving sleeve, a moving coil having first and second ends, a stationary magnet, and a ferromagnetic shaft;

a second amplifier having first and second inputs;

the second loudspeaker having a first grounded input and a second input operatively connected to the output signal;

the cone being attached to the moving sleeve;

the moving coil being wrapped around the moving sleeve;

a portion of the ferromagnetic shaft being displaced within a portion of the moving sleeve;

the ferromagnetic shaft being attached to the stationary magnet;

the first end of the coil being operatively connected to the input signal and the first input of the second amplifier;

the second end of the coil being operatively connected to the second input of the second amplifier;

the second amplifier producing the second signal.

2. A signal processor comprising:

a first amplifier for amplifying an input signal to produce a first signal;

a mixer for producing a third signal being the sum of the first signal and a second signal;

a third amplifier for amplifying the third signal to create an output signal;

a first loudspeaker operatively connected to the output signal;

a first processing component having, a second loudspeaker having a cone, a moving sleeve, a moving coil having first and second ends, a stationary magnet, and a ferromagnetic shaft;

a second amplifier having first and second inputs;

a variable resistor being operatively connected between the input signal and the first input of the second amplifier;

a first capacitor being operatively connected between the output signal and ground;

the second loudspeaker having a first grounded input and a second input operatively connected to the output signal;

the cone being attached to the moving sleeve;

the moving coil being wrapped around the moving sleeve;

a portion of the ferromagnetic shaft being displaced within a portion of the moving sleeve;

the ferromagnetic shaft being attached to the stationary magnet;

the first end of the coil being operatively connected to the input signal and the first input of the second amplifier;

the second end of the coil being operatively connected to the second input of the second amplifier;

the second amplifier producing the second signal.

* * * * *